United States Patent [19]

Holder

[11] Patent Number: 4,797,686

[45] Date of Patent: Jan. 10, 1989

[54] FLUID JET APPLICATOR FOR UNIFORM APPLICATIONS BY ELECTROSTATIC DROPLET AND PRESSURE REGULATION CONTROL

[75] Inventor: Joseph P. Holder, Greensboro, N.C.

[73] Assignee: Burlington Industries, Inc., Greensboro, N.C.

[21] Appl. No.: 21,358

[22] Filed: Mar. 3, 1987

Related U.S. Application Data

[60] Continuation-in-part of Ser. No. 908,289, Sep. 17, 1986, which is a division of Ser. No. 729,412, May 1, 1985, Pat. No. 4,650,694.

[51] Int. Cl.[4] ..... G01D 15/18; B05C 11/00; B05B 5/00

[52] U.S. Cl. ..... 346/1.1; 346/75; 118/692; 118/674; 118/695; 239/708

[58] Field of Search ..... 346/1.1, 75; 427/14.1, 427/28, 424, 445, 13; 430/496; 118/674–691, 695, 692; 239/690, 708

[56] References Cited

U.S. PATENT DOCUMENTS

| | | | |
|---|---|---|---|
| 2,770,210 | 11/1956 | Miller | 118/674 |
| 3,402,695 | 9/1986 | Baker et al. | 118/674 |
| 3,717,722 | 2/1973 | Messner | 358/78 |
| 3,909,831 | 9/1975 | Marchio et al. | 346/140 R |
| 3,915,113 | 10/1975 | Paton et al. | 118/674 |
| 4,013,037 | 3/1977 | Warning, Sr. et al. | 118/2 |
| 4,019,187 | 4/1977 | Omori et al. | 346/75 |
| 4,065,773 | 12/1977 | Berry | 346/75 |
| 4,087,825 | 5/1978 | Chen et al. | 346/75 |
| 4,164,001 | 8/1979 | Patnaude | 361/236 |
| 4,167,151 | 9/1979 | Muraoka et al. | 118/665 |
| 4,241,406 | 12/1980 | Kennedy et al. | 364/518 |
| 4,249,478 | 2/1981 | Gruener | 118/668 |
| 4,326,204 | 4/1982 | Erin | 346/75 |
| 4,357,900 | 11/1982 | Buschor | 118/681 |
| 4,381,342 | 4/1983 | Van Heyningen | 430/496 |
| 4,389,969 | 6/1983 | Johnson | 118/665 |
| 4,389,971 | 6/1983 | Schmidt | 118/669 |
| 4,412,505 | 11/1983 | Haüsler et al. | 118/674 |
| 4,432,690 | 2/1984 | Matt et al. | 427/424 |
| 4,449,476 | 5/1984 | Voswinckel et al. | 118/674 |
| 4,493,286 | 1/1985 | Carson | 118/677 |
| 4,523,202 | 6/1985 | Gamblin | 346/75 |
| 4,530,862 | 7/1985 | Kerzel | 427/445 |
| 4,561,377 | 12/1985 | Youngkeit | 118/33 |
| 4,568,947 | 2/1986 | Regnault | 346/75 |
| 4,578,965 | 4/1986 | Brossman | 68/205 R |
| 4,587,813 | 5/1986 | Dilling | 68/22 B |

FOREIGN PATENT DOCUMENTS

| | | |
|---|---|---|
| 751865 | 7/1980 | U.S.S.R. . |
| 904799 | 2/1982 | U.S.S.R. . |

*Primary Examiner*—E. A. Goldberg
*Assistant Examiner*—Gerald E. Preston
*Attorney, Agent, or Firm*—Nixon & Vanderhye

[57] ABSTRACT

A hybrid fluid jet apparatus is disclosed which is particularly useful in uniformly applying liquid dye to a fabric substrate. The applicator is controlled in an electrostatic control mode while operating below the practical limit of speed for electrostatic operation to achieve uniform fabric coverage. When fluid is being supplied to the substrate at its maximum flow rate in the electrostatic control mode, the applicator senses that the "full flow" condition has been reached. The applicator is then controlled to operate in a non-electrostatic control mode to control the fluid flow rate by modulating the fluid pressure received at the orifice array in accordance with the required fluid flow rate needed to achieve a uniform application of fluid to the substrate.

23 Claims, 4 Drawing Sheets

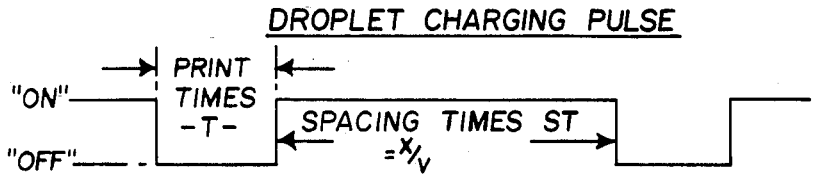
v = VELOCITY OF SUBSTRATE IN MACHINE DIRECTION
x = SPACING BETWEEN PIXEL CENTERS
T = PRINT TIME – 200 μs ≈ T MIN. ≤ T
V = VOLUME OF FLUID DELIVERED TO THE SUBSTRATE PER UNIT AREA – $1/\propto T/(T+ x/v)$
Δp = PIXEL DIMENSION ALONG MACHINE DIRECTION
Δp = Tv
FIG. 2
FIG. 3
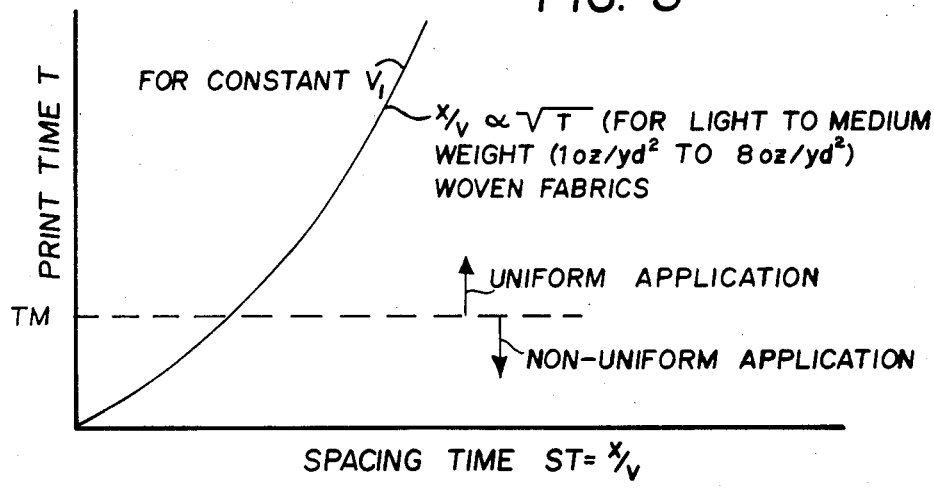
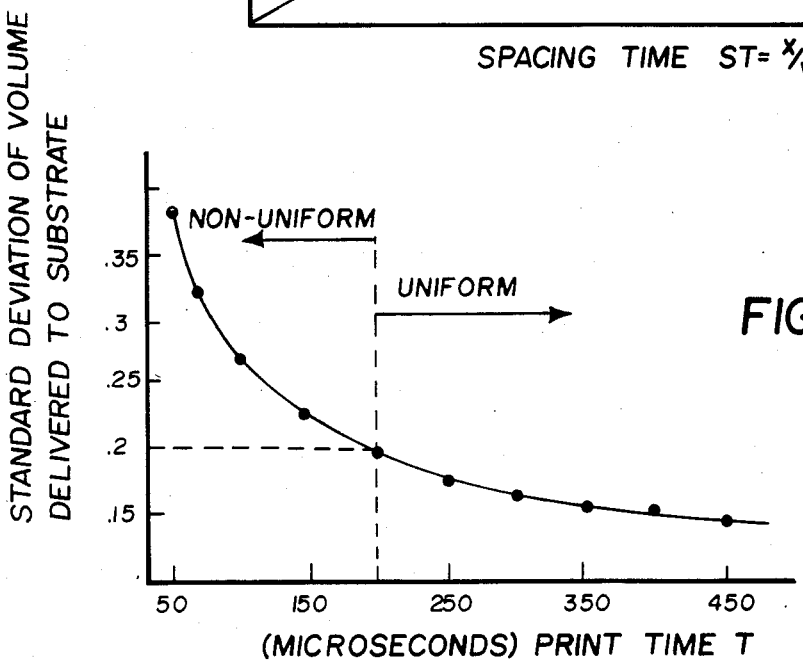
FIG. 4

OVERFLOW CONDITION IS REACHED WHEN SPEED IS INCREASED SO THAT PRINT PULSES ARE CALLED FOR SO FREQUENTLY THAT THERE IS NO "ON" TIME

FLUID JET APPLICATOR FOR UNIFORM APPLICATIONS BY ELECTROSTATIC DROPLET AND PRESSURE REGULATION CONTROL

CROSS REFERENCE TO RELATED APPLICATION

This invention is a continution-in-part of copending commonly assigned application Ser. No. 908,289 filed Sept. 17, 1986 which is a division of Ser. No. 729,412 filed May 1, 1985, now U.S. Pat. No. 4,650,694.

FIELD OF THE INVENTION

The invention relates to an improved method and apparatus for achieving uniform application of liquids onto substrate surfaces at significantly increased production rates with a liquid jet electrostatic applicator which employs a linear orifice array. The invention is particularly useful in the textile industry where such an applicator may be used to apply liquid dye, for example, and where uniform application thereof is required to provide color or shade solidity (i.e., uniformity of treatment by the dyestuff) throughout the surface and depth of a treated fabric substrate.

BACKGROUND AND SUMMARY OF THE INVENTION

One of the reasons for utilizing a fluid jet electrostatic applicator (such as the applicator disclosed in U.S. Pat. No. 4,650,694 which is hereby expressly incorporated by reference), is to achieve a fairly tight control over the amount of fluid that is actually applied to the textile in a given treating process (e.g., dyeing). In many conventional textile liquid treatment processes, a considerable amount of excess "add-on" liquid is necessarily applied to the textile. Subsequently, much effort and expense are typically encountered in removing this excess fluid from the textile. For example, some of the excess might be physically squeezed out of the textile (e.g., by passage through opposed rollers), but much of it will have to be evaporated by heated air flows or the like. This not only requires considerable investment of equipment, energy, time and real estate, it also often produces a contaminated flowing volume of air which must be further treated before it is ecologically safe for discharge. In addition, there is an obvious loss of the sometimes precious treating material itself—unless it is somehow recaptured and recycled which in itself involves yet further additional expense, effort, etc.

Accordingly, by applying only the needed amount of liquid "add-on" treatment to a fabric, there is considerable economic advantage to be had.

At the same time, in many applications (e.g., textile dyeing operations), the treating liquid must be uniformly distributed throughout the treated substrate if one is to achieve a commercially acceptable product. Furthermore, in typical commercial environments, it will be necessary for a single apparatus to successfully treat a wide variety of different types of textile substrates each having different requirements if one is to achieve uniformity.

For example, for solid shade dyeing in textile applications, the fluid jet applicator must be able to apply fluid in a uniform fashion to an entire range of commercial fabrics. Different styles of fabric vary considerably in terms of fiber content, construction, weave and preparation. These general parameters, when combined, in turn determine relative physical properties and characteristics of a given fabric such as porosity, weight, wettability, capillary diffusion (wicking) and the like. As will be appreciated, the volume of fluid per unit surface area required to adequately treat a given fabric is greatly influenced by these physical properties.

Fluid jet electrostatic applicators, such as the applicator described, in the aforementioned U.S. Pat. No. 4,650,694 are designed such that fluid is delivered out of the orifice array with a very limited operating fluid pressure range. Although the specific pressure range in a given applicator may vary depending on the size of the orifices in the array, the fluid pressure for such an applicator may, for example, be in a range of 3.5 to 4.5 p.s.i.

In such electrostatic applicators, once an optimum fluid pressure for a particular orifice array is determined, the fluid pressure level is maintained at this pressure level. In this manner, a breakup length for the droplets is provided which insures that the droplet breakup occurs while the droplet is directly opposed to the charging electrode which is on the order of 0.375 inches in length.

If the fluid pressure of an electrostatic applicator is increased to a level exceeding the above-mentioned optimum pressure, the droplet breakup length will be longer and the droplets will break up outside the charging area and will therefore, not be properly charged. Accordingly, in such electrostatic applicators, the conventional wisdom is that the maximum amount of fluid which may be placed on a substrate is limited to the volume of fluid which can be dispensed at the maximum fluid pressure for which droplet breakup would occur in the charging region.

Turning to a specific example, if a particular fabric weighs 5 oz. per square yard, it would typically require, in order to dye the fabric to a solid shade, 50% wet add-on to achieve the desired uniformity of solid shade. Given the maximum fixed fluid pressure of, for example, 4 p.s.i. to uniformly cover the 5 oz. per square yard of fabric with the 50% wet add-on requirement, the maximum speed for moving the substrate may for example, be 50 yards per minute. References herein to maintaining uniform coverage should be understood to include maintenance of a selected wet add-on level.

At this rate, the maximum amount of fluid is required out of the jet applicator to uniformly cover the fabric. This is called the "full flow" condition and is the practical limit of speed for a particular fluid applicator which is operating at a fixed fluid pressure to uniformly cover a particular fabric. When the "full flow" condition is reached all of the fluid being delivered through the orifice plate at a fixed fluid pressure is required by the substrate to maintain uniform coverage; therefore no droplets are being charged and deflected to the catcher. Prior to the present invention, operation approaching the "full flow" condition triggered the generation of a warning signal. Thus, prior to the present invention, the normal operation of electrostatic applicators has been at or below the full flow condition.

In the prior art, when operating below this "full flow" condition in the electrostatic control mode, since fluid is charged and deflected, if a jet goes out of alignment and fluid is sprayed on an electrode, a short may result. If a short develops, it will cause a defect in the fabric and will result in a dark mark or line on the fabric.

Advantageously, the method and apparatus of the present invention eliminate the possibility of shorts while operating at or beyond the "full flow" condition.

Additionally, the method and apparatus of the present invention serve to significantly increase production rates of electrostatic applicators by operating the jet applicator in an overdrive mode at fluid pressures heretofore not thought possible in electrostatic fluid applicators.

Furthermore, the present invention allows electrostatic fluid jet applicators to operate at fluid flow rates heretofore thought to be beyond the capabilities of electrostatic applicators, while at the same time maintaining a high degree of shade uniformity across the width of the fabric.

A hybrid fluid jet apparatus is disclosed whihh is particularly useful in uniformly applying liquid dye to a fabric substrate. The applicator is controlled in an electrostatic control mode while operating below the practical limit of speed for electrostatic operation to achieve uniform fabric coverage. When fluid is being supplied to the substrate at its maximum flow rate in the electrostatic control mode, the applicator senses that "full flow" condition has been reached. The applicator is then controlled to operate in a non-electrostatic control mode to control the fluid flow rate by modulating the fluid pressure received at the orifice array in accordance with the required fluid flow rate needed to achieve a uniform application of fluid to the substrate.

BRIEF DESCRIPTION OF THE DRAWINGS

These as well as other objects and advantages of this invention will be better appreciated by reading the following detailed description of the presently preferred exemplary embodiment taken in conjunction with the accompanying drawings, of which:

FIG. 2 is a schematic depiction of the relationship between repetitive print times T and spacing times ST for the apparatus of FIG. 1 in the electrostatic control mode.

FIG. 3 is a graph showing the observed parabolic relationship between print time T and spacing time ST for constant delivered volumes V per unit area of the substrate.

FIG. 4 is a graph of empirical data showing the observed exponential relationship between the statistical standard deviation of liquid volume delivered to the substrate and print times T.

DETAILED DESCRIPTION

Figure 1:
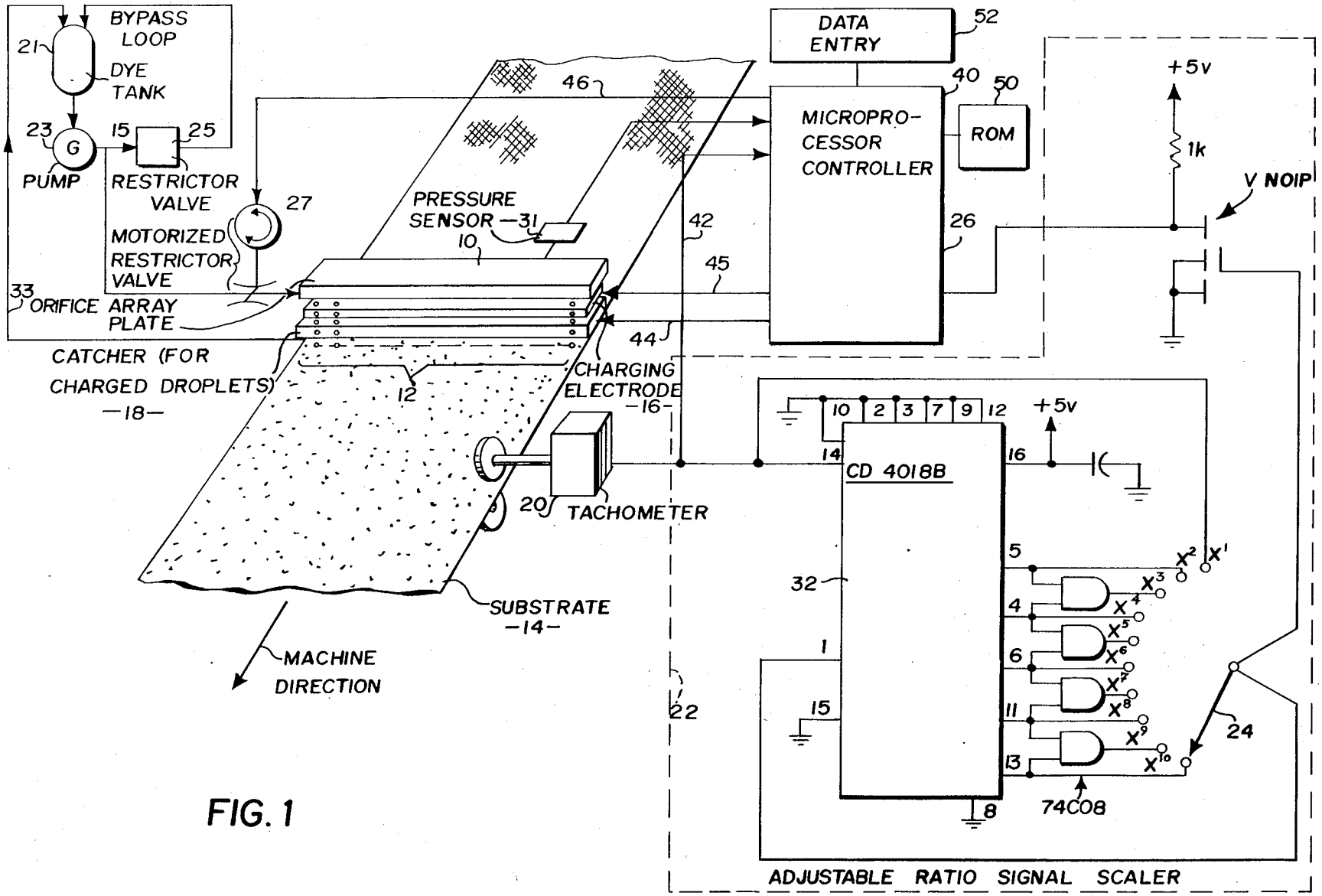
FIG. 1 is a schematic depiction of a liquid jet electrostatic applicator and control circuitry for operating in a normal electrostatic control mode and an "overdrive" mode.

A typical fluid jet electrostatic applicator which may be controlled to advantageously operate in a normal electrostatic control mode and an "overdrive" mode according to the present invention, is depicted in FIG. 1. Initially, the normal electrostatic mode of operation of the fluid jet applicator of FIG. 1 will be described.

The fluid jet applicator includes a random droplet generator 10. Associated with the droplet generator is a suitable fluid supply such as dye tank 21. In the normal electrostatic charging mode, the fluid system is controlled such that fluid from dye tank 21 is supplied at a constant regulated pressure to the orifice array which produces the fluid droplets used for printing.

As shown in FIG. 1, pressure is provided by pump 23 which draws fluid from the bottom of dye tank 21 through a filter (not shown). By way of example only, pump 23 may be implemented by two magnetically coupled gear pumps Models TMM-1078 and TMM-1079 manufactured by Tuthill Pump Company. The pumps may be mounted on a single Baldor 5Hp, 3 phase, 230-480 volt motor, where one pump is turning clockwise and the other counter-clockwise.

A restrictor valve 25 on the output side of pump 23 is set to maintain a 15 psi head pressure and allows excess fluid to return to the dye tank 21 while maintaining a constant head pressure downstream. Fine pressure regulation of the fluid supplied to the orifice plate is achieved by a motorized valve 27. The motorized valve may be, for example, a Chemtrol electrcally actuated valve MAR-8-8-4, ½ inch. The motorized valve will be adjusted by controller 40 to deliver the desired fluid pressure. Controller 40 monitors the pressure at the orifice plate via pressure sensor 31 and corrects for pressure changes due, for example, to the loading of filters.

In the normal electrostatic operating mode, the fluid system is controlled to provide a fixed optimum fluid pressure tailored to the particular orifice array so that the breakup length for the droplets is such that droplet breakup occurs while the droplets are directly opposed to the charging electrode. If the charging electrode 16 is energized, then droplets formed at that time within the charging zone will become electrostatically charged.

Under the control of the above-described fluid system, fluid is supplied to a linear array of liquid jet orifices in a single orifice array plate disposed to emit parallel liquid streams or jets which randomly break into corresponding parallel lines of droplets 12 falling downwardly toward the surface of a substrate 14 moving in the machine direction (as indicated by an arrow) transverse to the linear orifice array. A droplet charging electrode 16 is disposed so as to create an electrostatic charging zone in the area where droplets are formed (i.e., from the jet streams passing from the orifice plate). A subsequent downstream catching means includes a deflection electrode (not shown) which generates an electrostatic deflection field for deflecting such charged droplets into a catcher 18 where they are typically collected, reprocessed and recycled via line 33 to the fluid supply dye tank 21. In this arrangement, only those droplets which happen *not* to get charged are permitted to continue falling onto the surface of substrate 14.

The random droplet generator 10 may employ absolutely no artificial droplet stimulation means or, alternatively, it may employ conventional stimulation or a form of random, pseudo-random or noise generated electrical signals to drive an electroacoustic transducer or the like which, in turn, is acoustically coupled to provide random droplet stimulation forces. As explained in depth in the U.S. Pat. No. 4,650,694 such random droplet generating forces are often preferred so as to avoid standing waves or other adverse phenomena which may otherwise limit the cross-machine dimensions of the linear orifice array extending across the moving substrate 14.

As explained above, it is very desirable (especially in the context of textile applications) to achieve a uniform application of a controlled liquid volume per unit area of substrate so as to avoid the application of any "excess" treating liquid and the attendant problems otherwise to be encountered.

To achieve the necessary control and also achieve the desired uniformly treated textile substrate, the system of FIG. 1 provides an apparatus for electronically adjusting the center-to-center pixel spacing between occurrences of individual print time pulses along the longitudinal or machine direction of substrate motion. In this regard, it is noted that in a given "print time" a packet of droplets form a corresponding printed "pixel" (i.e., a picture element). The apparatus of FIG. 1 provides a uniform solid shade dye uniformity (within the solid portions of a given pattern application) by one or all of the ink jets within the linear orifice array, so as to make the apparatus usable on a relatively wider range of commercially desirable textile products. This adjustment of center-to-center pixel spacing in conjunction with proper control over the print time duration at each pixel site provides the desired result.

In particular, in the exemplary embodiment of FIG. 1, a tachometer 20 is mechanically coupled to substrate motion. For example, one of the driven rollers of a transport device (not shown) used to cause substrate motion (or merely a follower wheel or the like) may drive the tachometer 20. In the exemplary embodiment, the tachometer 20 may comprise a Litton brand shaft encoder Model No. 74BI1000-1 and may be driven by a 3.125 inch diameter tachometer wheel so as to produce one signal pulse at its output for every 0.010 inch of substrate motion in the longitudinal or machine direction. It will be appreciated that such signals will also occur at regular time intervals provided that the substrate velocity remains at a constant value. Accordingly, if a substrate is always moved at an approximately constant value, then a time driven clock or the like possibly may be substituted for the tachometer 20 as will be appreciated by those in the art.

Thus, by one means or another, an input signal is applied to the adjustable ratio signal scaler 22 for each passage of a predetermined increment of substrate movement in the machine direction (e.g., for each, 0.010 inch). The ratio between the number of applied input signals and the number of resulting output signals from the signal scaler 22 is adjustable (e.g., by virtue of switch 24).

When an output signal is produced by the signal scaler 22, then a conventional print time controller as, for example, shown, in the above-mentioned U.S. Pat. No. 4,650,694 generates a print time pulse for the charging electrode 16 (which actually turns the charging electrode "off" for the print time duration in the exemplary embodiment). The print time controller in U.S. Pat. No. 4,650,694 was identified as being, for example, a monostable multivibrator with a controllable period by virtue of potentiometers which may constitute a form of print time duration control. In the aforementioned application, a fixed resistor provides means to insure that there is always a minimum duration to each print time pulse while a variable resistor provides a means for varying the duration of the print time pulse at values above such a minimum. This same apparatus may likewise be employed in the present invention to effect print time control.

Alternatively, in the present invention, the above-described functions of the print time controller and potentiometers of the aforementioned application may, by way of example only, be performed by a microprocessor based controller 40. Thus, during operation in the normal electrostatic operating mode, when an output signal is produced by signal scaler 22, controller 40 generates a print time pulse for charging electrode 16. The controller 40 insures, as did the potentiometers in the aforementioned application, that there is always a minimum duration to each print time pulse while controllably varying the duration of the print time at values above the minimum. Controller 40, as noted above, includes a microprocessor, which, by way of example only, may be an Intel 8080.

As will be appreciated by those skilled in the art, the generated print time pulses will be conventionally utilized to control high voltage charging electrode supply circuits so as to turn the charging electrode 16 "on" (during the intervals between print times) and "off" (during the print time interval when droplets are permitted to pass on toward the substrate 14).

For any given setting of switch 24, there is a fixed center-to-center pixel spacing. For example, if tachometer 20 is assumed to produce a signal each, 0.010 inch of substrate movement, and if switch 24 is assumed to be in the X1 position, then the center-to-center pixel spacing will also be 0.010 inch because the controller 40 will be stimulated once each 0.010 inch.

However, the input to the signal scaler 22 also passes to a digital signal divider circuit 32 (e.g., an integrated COS/MOS divide by "N" counter conventionally available under integrated circuit type No. CD4018B). The outputs from this divider 32 are used directly or indirectly (via AND gates as shown in FIG. 1) to provide input/output signal occurrence ratios of 1:1 (when the switch is in the X1 position) to 10:1 (when the switch is in the X10 position) thus resulting in output signal rates from the scaler 22 at the rate of one pulse every 0.010 inch to one pulse every 0.100 inch and such an output pulse rate can be adjusted in 0.010 inch increments via switch 24 in this exemplary embodiment. The FET output buffer VNOIP merely provides electrical isolation between the signal scaler 22 and the controller 40 while passing along the appropriately timed print time stimulus signal pulse to the controller 40. Thus, the center-to-center spacing of pixels in the machine direction can be instantaneously adjusted by merely changing the position of switch 24. As will be appreciated by those in the art, there are many possible electrical circuits for achieving such independent but simultaneous control over center-to-center pixel spacing and the minimum duration of print time intervals. Expanded ranges of signal ratios as well as closer or even vernier increments of signal ratio adjustments may be utilized if desired.

If the apparatus of FIG. 1 is utilized for achieving uniform solid shade coloring (e.g., dyeing) of substrates (e.g., fabrics), then the center-to-center pixel spacing becomes a limiting factor when the distance between individual pixels becomes so great that one can now perceive discrete cross-machine lines on the substrates which do not properly converge (e.g., due to wicking characteristics of the fabric so as to produce uniform coverage). This upper limit on the center-to-center pixel spacing will vary, of course, from one fabric to another due to the different physical properties of such fabrics as earlier discussed.

While the just-discussed limitation for uniform solid shade coloring exists, that very limitation can itself be productively utilized to achieve some limited patterning capability. For example, one may produce desirable patterns by purposefully creating discernible discrete lines (cross-machine stripes, for example) of constant or variable spacing along a textile substrate. A varying pattern can be created, for example, by using a variable signal ratio control circuit (e.g., by manually or electronically controlling the rate of change of switch 24 or its equivalent). By manipulating the independently controlled print time duration and/or center-to-center pixel spacing using the system of FIG. 1, discernible line patterns of variable separation, width and intensity may be achieved for particular design purposes on the substrate material.

As should be appreciated, if a two-dimensional print pattern is desired, then the droplet charging electrode 16 may be segmented to a cross-machine pixel dimension and individual pattern control over these plural charging electrodes can be superimposed with the output of the controller 40.

The relationship between print times T and spacing times ST is depicted graphically in FIG. 2. As shown and as previously explained, the print time T occurs when the charging electrode 16 is turned "off". If one assumes that the velocity of the substrate in the machine direction is v and if one also assumes that the signal scaler 22 is set so as to produce a predetermined center-to-center pixel spacing x, then the spacing time ST is equal to x/v. As also previously explained, the print time T should be above about 200 microseconds so as to produce a standard deviation of delivered liquid volume along the array of less than approximately 0.2 (see FIG. 4). It should also be appreciated that the volume V of fluid delivered to the substrate per unit area is proportional to the duty cycle of print time which is, $T/(T+x/v)$. Furthermore, if one assumes zero wicking capability of the substrate and theoretically perfect conditions otherwise, then the nominal pixel dimension along the machine direction p will be equal to Tv. In actuality, due to wicking and other phenomena, in the preferred exemplary embodiment of a uniform dye shade applicator in the fabric or textile industries, the applied liquid at each pixel location will itself become distributed throughout the fabric substrate and therefore there will be no discernible delineations between pixel areas in the finished product.

Referring to FIG. 3, as explained in the above-mentioned copending application, it has been empirically observed that for a constant delivered fluid volume V, changes in spacing times ST should be approximately proportional to the square root of the print time T. This observation has been made for light-to-medium weight (1 ounce per square yard to 8 ounces per square yard) woven fabrics. As depicted in both FIGS. 3 and 4, it has also been empirically observed that non-uniformity in liquid application can be expected for print times T less than about 200 microseconds. Alternatively stated, in view of the observed data depicted in FIG. 4 of standard deviations of volume delivered to the substrate versus print time T, the non-uniformity can also be expected when such standard deviation of delivered volume exceeds about 0.2. As will be appreciated, the exact point at which liquid application changes from a non-uniform to uniform state is a somewhat subjective determination. However, based on empirical observations, the just-stated limits are approximate critical operational limits for the exemplary system. In this system the orifice array comprised orifices of 0.0037 inch diameter spaced apart by 0.016 inch over a cross-machine dimension of 20 inches using either disperse or reactive dyes having a liquid viscosity of 1.2 cps with a fluid pressure of 4.5 psi and psuedo-random droplet stimulation with a statistical mean of about 19,094 cycles per second and a standard deviation of about 2800 cycles per second.

Reference may be made to FIGS. 5–8 of application Ser. No. 729,412 for photographs which demonstrate the effect on uniformity of various print time pulse durations and spacing intervals therebetween. The data in these photographs demonstrate that by appropriately selecting the print time and center-to-center pixel spacing, uniform solid dye shades may be achieved to produce the desired commercial product while avoiding application of excess liquid on the product.

As should now be appreciated, the circuit of FIG. 1 permits one to use random droplet generating processes in a liquid jet electrostatic applicator (e.g. thus permitting larger cross-machine dimensions for use in the textile industry) while simultaneously achieving commercially acceptable uniform liquid application (e.g. to a textile substrate having given characteristics) while also simultaneously avoiding the application of excess "add-on" liquid (e.g. dyestuffs) and thus providing a significant economic advantage (e.g. when applied to the textile industry). These same desirable simultaneous results can be achieved with a single liquid jet electrostatic applicator for a relatively wider range of fabric substrates by virtue of the adjustable ratio signal scaler 22 used in conjunction with the controller 40 for print time control as described above in the normal electrostatic operating mode.

NON-ELECTROSTATIC CONTROL MODE OF OPERATION

In accordance with the present invention, the production rate of an electrostatic fluid jet applicator, such as the applicator described in the above-mentioned application, may be greatly enhanced by operating the applicator in an overdrive mode beyond the "full flow" condition. In the electrostatic fluid jet applicator system of the above-mentioned U.S. Pat. No. 4,650,694, an operator would select the amount of grams per square yards of flow for a particular fabric. When the speed is reached at which the maximum fluid of the system is required to achieve uniformity of solid shade, the system turns on a warning light indicating the full flow condition.

In accordance with the present invention, controller 40 monitors the fluid jet applicator's operation and determines that the system has entered the full flow condition. As will be described, instead of warning the operator regarding this condition, the applicator is controlled to operate in a non-electrostatic control mode.

In order to determine that the full flow condition has been entered, the controller 40 monitors the tachometer 20 output on line 42. The tachometer generates a signal pulse for every 0.01 inch of substrate motion. As the substrate moves faster, the tachometer pulses occur more frequently in time.

As noted above, the print time T is the duration of the charge voltage off time, which time is determined by the fabric weight and desired amount of liquid add-on.

Figure 5:
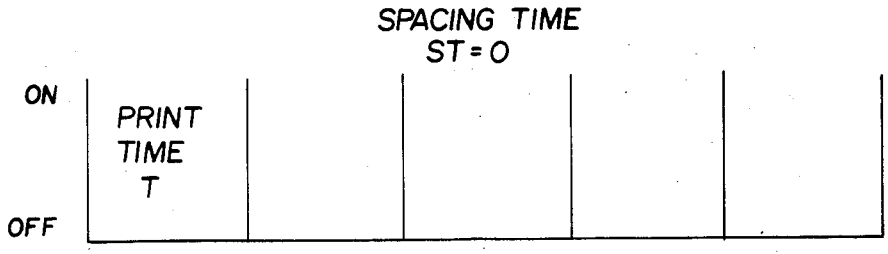
FIG. 5 is a schematic depiction of print pulses when the "full flow" condition is reached.

A typical print pulse has been described with respect to FIG. 2. Pulses occur at a fixed number per linear inch with a frequency dependent on the fabric speed. As the speed is increased, the print pulses occur at increased frequency until at some speed they consume all of the spacing time ST since a new print pulse is required before the last one is complete as represented in FIG. 5.

The controller 40 recognizes this "full flow" condition. As noted previously, at this speed the maximum amount of fluid is required out of the jet applicator to uniformly cover the fabric. This "full flow" condition is the practical limit of speed for a particular electrostatic fluid applicator operating at a fixed fluid pressure to uniformly cover a particular fabric.

The "full flow" condition can be sensed in a variety of ways. For a given fabric, as noted above, the print time is determined by the fabric weight and the desired amount of liquid add-on. For a given selection of center-to-center pixel spacing and print time, the substrate speed at which the "full flow" condition occurs (i.e., the maximum speed for operation at the fixed fluid pressure) is calculated by controller 40 using the following formula:

$$\text{Maximum speed } (YPM) = \frac{\text{pixel spacing (In.)}}{\text{print time (Sec.)}} \times 1.667,$$

where 1.667 is the factor for converting inches per second into yards per minute.

Figure 7:
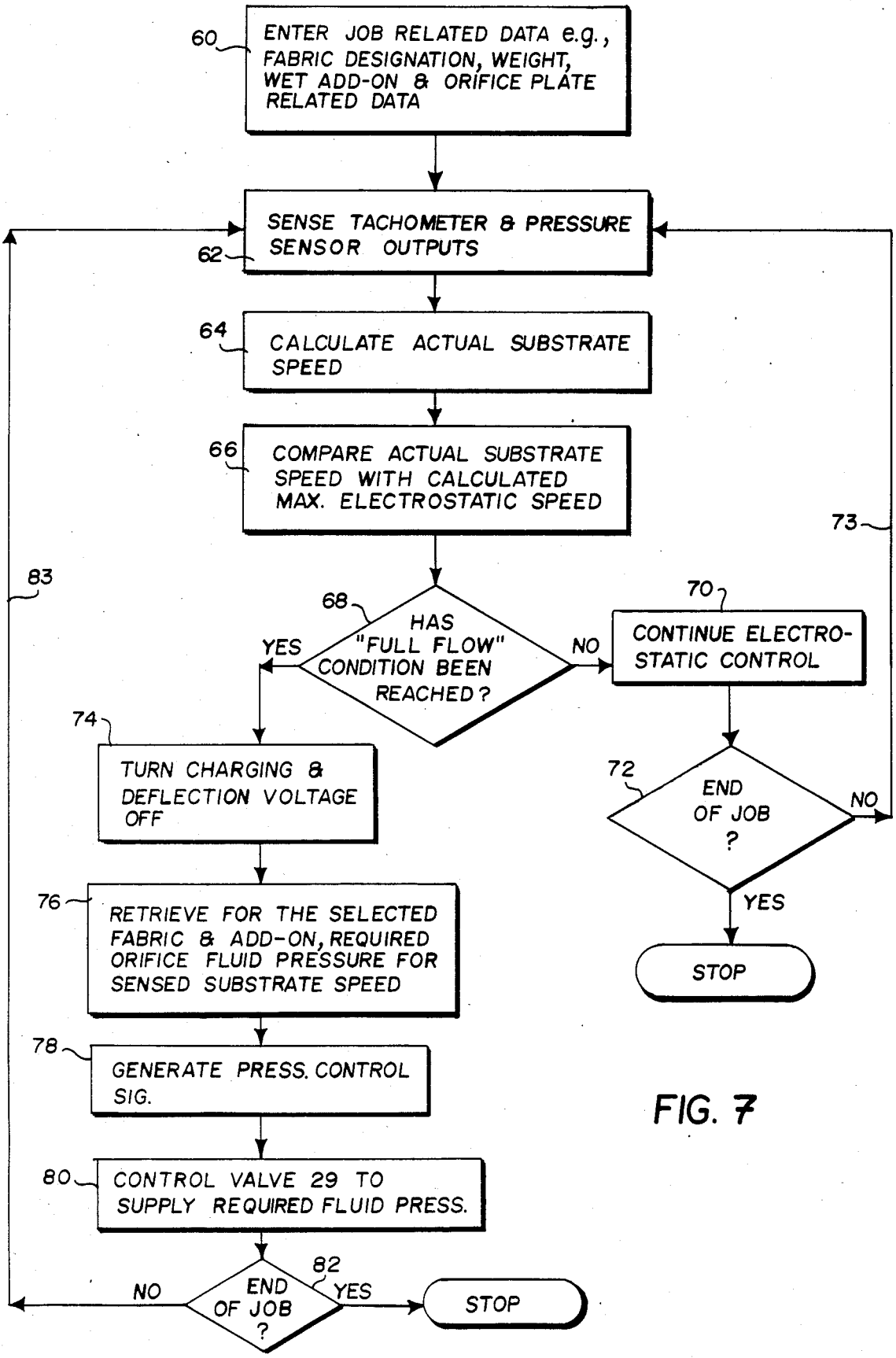
FIG. 7 is a flowchart which depicts the sequence of operation performed by controller 40 with respect to controlling operation in the non-electrostatic mode.

As shown in the flowchart of FIG. 7, after entering (via terminal 52) job related data such as fabric designation indicia, fabric weight and desired liquid add-on, orifice plate flow factor (i.e., the adjustment for fluid flow rate of a particular orifice plate) and desired fluid pressure, the controller 40 reads the output of both the tachometer 20 and pressure sensor 31 (see flowchart blocks 60 and 62). Since controller 40 receives signals from tachometer 20 it can readily determine the substrate speed (64). Controller 40 then compares the sensed substrate speed with the calculated maximum speed which is indicative of the "full flow" condition (66). If the actual substrate speed is less than the maximum substrate speed, then the "full flow" condition has not been reached (68) and electrostatic control is continued (70). Assuming that the job is not completed, the speed and pressure parameters are continuously sampled (72 and 73).

As explained above, in electrostatic applicators in order to insure that droplet breakup occurs while the droplet is directly opposed to the charging electrode, the fluid pressure has heretofore been fixed at the optimum fluid pressure which achieves this end. If the fluid pressure exceeds this fixed level, the droplets will not be properly charged. Thus, a fixed fluid pressure has heretofore been a basic constraint on the operation of electrostatic droplet fluid jet applicator control systems.

The inventor has recognized that this basic constraint of fixed pressure in electrostatic applicators may be overcome if the system is operated in an overdrive mode at the full flow condition or beyond. As explained above, at the electrostatic applicator's fixed fluid pressure, to uniformly cover a particular fabric which, for example, weighs 5 oz. per square yard with a 50% wet add-on required, the fastest possible rate the fabric substrate may be moved is, for example, 50 yards per minute. At this rate, which heretofore was viewed as the practical limit of speed for an electrostatic applicator, the maximum amount of fluid is required out of the jet applicator orifices to uniformly cover the fabric.

In order to receive the maximum amount of liquid out of the applicator, the inventor further recognized that the demand for fluid is so high that no droplets may be deflected. Thus, the charging electrode will be controlled to be off. Since there is no need for a deflection field in this mode, in accordance with the present invention, the deflection electrode voltage is also turned off.

Turning back to FIG. 1 and FIG. 7, as soon as controller 40 senses entry into the "full flow" condition (flowchart block 68), the controller 40 exits the electrostatic control mode and generates signals on lines 44 and 45 which turns off the deflection and charging electrode voltages. With the deflection and the droplet charging electrode voltages turned off, electrical shorts caused by misaligned jets will not occur during the full flow application mode. Accordingly, the aforementioned defects in the fabric due to such electrical shorts will not occur during full flow conditions.

The inventor has further recognized that once the charging electrode voltage is off, the concern which led to a fixed fluid pressure design, i.e., to insure that the droplets are properly charged, is no longer a viable operating constraint. According to the present invention, once the controller 40 senses the "full flow" condition, fluid flow is controlled by regulating the orifice fluid pressure. In this regard, the pump's electrically activated valve 27 is controlled via line 46 to drive liquid to the orifice array at an increased pressure. The substrate is thereafter controlled by a fabric drive system (not shown) to move at a faster rate while maintaining the same add-on level and while maintaining uniform fabric coverage. Thus, upon sensing the full flow condition, the controller 40 will control the fluid pressure such that as the substrate speed is increased (as sensed by tachometer 20), the fluid pressure will be increased so that uniform fabric coverage will result. The fluid pressure must be continuously adjusted via signals from controller 40 on line 46 as the speed of the line changes.

Changes in fluid pressure will not be as quickly responsive to control signals received by the motorized restrictor valve 27 when compared to the rate at which the substrate 14 speed may be changed. In this regard, the speed at which the pump's mechanical elements, such as valve 27, respond to control signals requesting a pressure change, is not as fast as the electronically controlled speed-modifying elements in the substrate. Accordingly, the pump pressure may have to be initially raised more sharply to compensate for this difference in response time. Alternately, in this mode of control the rate of substrate speed change may have to be slowed to agree with the response time of fluid pressure regulation.

The precise correlation between pressure increases necessary under full flow conditions and fabric speed may be determined empirically for a given fabric and such correlated data is stored in ROM 50 of FIG. 1. The relationship between substrate throughput speed and pressure may have to be tailored to each specific fluid bar design in order to take into account variations in volumes and elasticity of components. Moreover, the amount of fluid to be placed on a given fabric is a function of the weight of the fabric, the fabric absorbency and construction.

Figure 6:
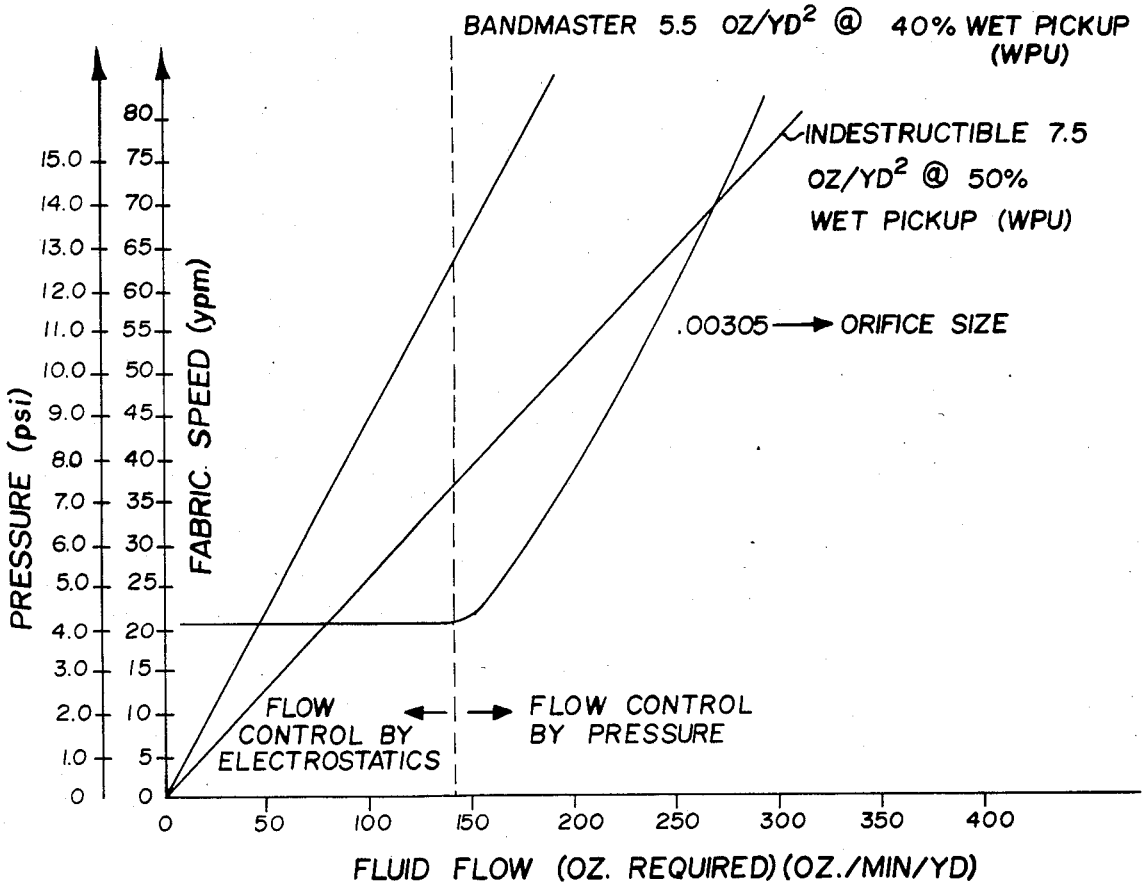
FIG. 6 is a graph of empirical data showing the observed relationship between fabric speed and fluid flow correlated with orifice fluid pressure.

FIG. 6 shows a graph which illustrates the data relating to the wet pick up requirements for two fabrics referred to as "Bandmaster" and "Indestructible". The graph plots the fabric speed in yards per minute as a function of fluid flow in ounces per min. per yard. As shown by the graph, the fabric speed and the fluid flow required to achieve the desired wet pick up are linearly related.

Superimposed on the graph is an empirically obtained line indicating the relationship between pressure and fluid flow for a fluid bar having 0.00305 orifice diameters. The dotted line shown on the graph delineates the fluid flow control in the electrostatic control mode and in the overdrive mode, where flow control is based on pressure. As explained above, like the prior art, under electrostatic control, the fluid applicator of the present invention while operating at a fixed pressure has a maximum fluid flow rate at which uniform fabric coverage can be achieved (which, in the example shown in FIG. 86, is 143 ounces per minute per yard). This fluid flow rate corresponds to the "full flow" condition for the fabrics shown in the graph using the orifice size shown.

In order to achieve fluid flow rates above 143 ounces per minute per yard, the fluid pressure must be increased. As shown by FIG. 6, the need to increase pressure does not rise in a strictly linear relationship with increased fluid flow rate.

Based upon empirically obtained data such as that represented by the graph of FIG. 6, such data for a particular orifice size may be stored in ROM 50 and retrieved by controller 40.

Focusing on the data in the graph of FIG. 6, for the fabric Indestructible at a fabric speed of 55 yards per minute, the graph shows that it would be necessary to achieve a fluid flow rate of 210 ounces per minute per yard to achieve the required uniform coverage. Moreover, according to FIG. 6, to achieve a flow rate of 210 ounces per minute per yard, a pressure of approximately 8.6 psi would be required. Similarly, related data for this and other points on the graph would be stored in ROM 50.

Thus, according to the present invention, an operator desiring to run Indestructible would, for example, enter a fabric designator and the desired dye add-on in grams per square yard via data entry 52 shown in FIG. 1. The user also would enter data for calibrating the system to account for differences in flow rates of different orifice plates. In this regard, an orifice plate factor and the operating pressure with which the applicator is to operate would be entered. Print time pulses are generated on line 45 in the electrostatic operating mode in the manner described in U.S. Pat. No. 4,650,694. Based on the fabric speed signal from tachometer 20, controller 40 senses when the full flow condition had been reached as discussed above.

When the "full flow" condition is detected, the charging and deflection electrode voltages are turned off (see flowchart block 74) and for a particular sensed fabric speed, an associated fluid pressure is retrieved from ROM 50 (See flowchart block 76). Thereafter, a corresponding "pressure increase" signal is transmitted to motorized valve 27 (See flowchart blocks 78 and 80). As noted above, if a 55 yard per minute speed is sensed, valve 27 is controlled to produce approximately 8.6 psi at the orifice array. Controller 40 also turns off the deflection electrode voltage via a signal on line 44. Unless the job has ended (see flowchart 82), the pressure and substrate speed parameters are repetitively sensed as indicated in line 83 of the flowchart of FIG. 7.

Studies of fluid flow versus pressure for electrostatic fluid jet applicators have shown that increases in fluid flow of 50–100% are possible over a practical pressure range. Such studies have further shown that fluid flow across the width of the orifice is the most uniform at the "full flow" condition where there is no interaction of the charge and deflection electronics on the fluid. Upon slowing down the line speed, the fluid applicator would be returned to the charge/deflection mode of droplet control when it reaches the standard operating pressure at which it was functioning before the upward adjustment of speed and pressure.

While the present invention has been described in terms of its presently preferred form, it is not intended that the invention be limited only by the described embodiment. It will be apparent to those skilled in the art that many modifications may be made which nevertheless lie within the spirit and intended scope of the invention as defined in the claims which follow.

I claim:

1. A hybrid fluid jet applicator having an orifice array, means for supplying pressurized fluid to said orifice array, and means for selectively charging and deflecting fluid droplets to control the quantity of fluid striking a moving substrate, said hybrid fluid jet applicator further comprising:

means for controlling said fluid jet applicator to operate in an electrostatic control mode;

means for sensing when said fluid is being supplied at a predetermined flow rate in said electrostatic control mode and for generating a signal indicative thereof; and means, responsive to said signal from said means for sensing, for controlling said applicator to operate in a non-electrostatic control mode and for increasing said flow rate to a level beyond said predetermined rate.

2. A hybrid fluid jet applicator according to claim 1, wherein said means for selectively charging and deflecting fluid droplets includes charging and deflection electrodes and voltage supply means for supplying a predetermined voltage to said charging and deflection electrodes, further including means, responsive to said signal from said means for sensing, for turning off said voltage supply means.

3. A hybrid fluid jet applicator according to claim 1, wherein said means for supplying pressurized fluid includes a pump and pressure regulator means for regulating the fluid pressure produced by said pump which is received by said orifice array, and wherein said means for regulating the fluid pressure produced by said pump controls said pump to produce a fixed fluid pressure during operation in said electrostatic control mode.

4. A hybrid fluid jet applicator according to claim 3, wherein said means for controlling said applicator to operate in non-electrostatic control mode includes means coupled to said means for regulating the pump fluid pressure for controlling fluid flow by regulating the fluid pressure at said orifice array.

5. A hybrid fluid jet applicator according to claim 1, wherein said means for controlling operation in an electrostatic control mode and a non-electrostatic control mode include means for disposing a uniform application of fluid per unit area on said substrate.

6. A hybrid fluid jet applicator according to claim 1, wherein said means for controlling the applicator to operate in a non-electrostatic control mode includes data processing means having means, for a predetermined orifice array, for storing a set of orifice array fluid pressures required to achieve an associated set of fluid flow rates.

7. A hybrid fluid jet applicator according to claim 6, wherein said means for supplying pressurized fluid includes a pump and means for regulating the fluid pressure produced by said pump which is delivered to said orifice array, and wherein said data processing means is operable during said non-electrostatic control mode to provide pressure control signals to said means for regulating pressure to modulate the fluid pressure received at the orifice array in accordance with the required fluid flow rate needed at a predetermined substrate speed to achieve a uniform application of fluid to said substrate.

8. A hybrid fluid jet applicator according to claim 1, further including means for switching the control mode from said non-electrostatic control mode to said electrostatic control mode when the speed of the moving substrate drops down to a predetermined level.

9. A hybrid fluid jet applicator according to claim 4, wherein said means for controlling said applicator to operate in a non-electrostatic mode includes means for generating pressure control signals and wherein said means for regulating the fluid pressure includes valve means responsive to said pressure control signals for delivering a fluid pressure to said orifice plate in accordance with said pressure control signals.

10. In a fluid jet applicator having an orifice array, means for supplying pressurized fluid to said orifice array, means for selectively charging and deflecting fluid droplets to control the quantity of fluid striking a moving substrate, a method of applying uniform applications of fluid to said substrate comprising the steps of:

controlling the application of said fluid in an electrostatic control mode;

determining when said fluid is being supplied at a predetermined flow rate in said electrostatic control mode;

generating a signal indicative of said predetermined electrostatic flow condition;

controlling fluid application operation in response to said signal in a non-electrostatic mode; and increasing said flow rate in the non-electrostatic mode to a level beyond said predetermined rate.

11. A method according to claim 10, wherein said means for charging and deflecting fluid droplets include charging and deflection electrodes and voltage supply means for supplying a predetermined voltage to said charging and deflection electrodes, and further including the step of turning off the voltage supply means in response to said signal.

12. A method according to claim 10, wherein said means for supplying pressurized fluid includes a pump and pressure regulator means for regulating the fluid pressure produced by said pump which is delivered to said orifice array, and further including the step of controlling the pump to produce a fixed fluid pressure during operation in said electrostatic control mode.

13. A method according to claim 12, wherein step of controlling said applicator to operate in a non-electrostatic control mode includes controlling fluid flow by regulating the fluid pressure which is delivered to said orifice array.

14. A method according to claim 10, wherein step of controlling the applicator to operate in a non-electrostatic control mode includes the step of storing, for a predetermined orifice array, a set of orifice array fluid pressures required to achieve an associated set of fluid flow rates.

15. A method according to claim 10, wherein said means for supplying pressurized fluid includes a pump and means for regulating the fluid pressure produced by said pump which is delivered to said orifice array, and further including data processing means operable during said non-electrostatic control mode for generating pressure control signals; said method further including the step of providing the pressure control signals to the means for regulating pressure to modulate the fluid pressure produced by said pump which is delivered to the orifice array in correspondence with the required fluid flow rate needed at a predetermined substrate speed to achieve a uniform application of fluid to said substrate.

16. A method according to claim 10, further including the step of switching the control mode from said non-electrostatic control mode to said electrostatic control mode when the speed of the moving substrate drops down to a predetermined level.

17. A method according to claim 13 wherein said means for regulating fluid pressure includes valve means, said method further including the step of generating pressure control signals upon sensing entry into the non-electrostatic control mode and controlling the valve means to deliver a fluid pressure at said orifice plate in accordance with the pressure control signals.

18. A multiple mode fluid jet applicator having an orifice array, means for selectively charging and deflecting fluid droplets to control the amount of fluid which is applied to a substrate, and means for moving said substrate, said applicator comprising:

fluid pressure control means for setting operating fluid pressure at which the droplet breakup length will be such as to insure that the droplets will be properly charged during an electrostatic operating mode;

means for sensing when the maximum flow of fluid is being applied to the substrate during the electrostatic droplet charging mode of operation, and for generating a signal indicative thereof;

non-electrostatic mode control means responsive to said signal for controlling the fluid pressure delivered to said orifice array to increase fluid flow when the substrate moves at a greater speed than possible during said electrostatic mode to maintain uniform application of fluid to said substrate.

19. A multiple mode fluid jet applicator according to claim 18, including means responsive to said signal for deenergizing said means for selectively charging and deflecting.

20. A multiple mode fluid applicator according to claim 18, wherein said fluid pressure control means includes a pump and pressure regulation means for regulating the fluid pressure produced by said pump which is received at said orifice array and for generating during said electrostatic mode a fixed fluid pressure.

21. A multiple mode fluid jet applicator according to claim 20, wherein said non-electrostatic mode control means includes means coupled to said means for regulating the fluid pressure which is received at said orifice array for generating pressure control signals for modulating fluid flow by regulating the fluid pressure.

22. A multiple mode fluid jet applicator according to claim 18, wherein said non-electrostatic mode control means includes data processing means having means, for a predetermined orifice array, for storing a set of orifice array fluid pressures required to achieve an associated set of fluid flow rates.

23. A multiple mode fluid jet applicator according to claim 18, wherein said fluid pressure control means includes a pump and means for regulating the fluid pressure produced by said pump, and data processing means operable during said non-electrostatic control mode to provide pressure control signals to said means for regulating pressure to modulate the fluid pressure received at said orifice array in correspondence with the required fluid flow rate needed at a predetermined substrate speed in order to achieve a uniform application of fluid to said substrate.

* * * * *